US008322096B2

(12) United States Patent
Visser

(10) Patent No.: US 8,322,096 B2
(45) Date of Patent: Dec. 4, 2012

(54) WALL SYSTEM FOR A BUILDING

(76) Inventor: Michael Visser, Kent, WA (US)

( * ) Notice: Subject to any disclaimer, the term of this patent is extended or adjusted under 35 U.S.C. 154(b) by 0 days.

(21) Appl. No.: 12/772,777

(22) Filed: May 3, 2010

(65) Prior Publication Data

US 2011/0146173 A1 Jun. 23, 2011

Related U.S. Application Data

(60) Provisional application No. 61/289,034, filed on Dec. 22, 2009.

(51) Int. Cl.
*E04B 1/00* (2006.01)

(52) U.S. Cl. ..... 52/289; 52/415

(58) Field of Classification Search ..... 52/415, 52/289, 702, 432, 424, 425, 309.2–309.9, 52/784.11, 790.1, 794.1, 800.1
See application file for complete search history.

(56) References Cited

U.S. PATENT DOCUMENTS

| | | | | |
|---|---|---|---|---|
| 4,183,987 | A * | 1/1980 | Eby et al. | 428/192 |
| 2005/0086905 | A1* | 4/2005 | Ralph et al. | 52/782.1 |
| 2007/0028543 | A1* | 2/2007 | Lachance | 52/317 |
| 2008/0006002 | A1* | 1/2008 | Strickland et al. | 52/737.6 |
| 2008/0104918 | A1* | 5/2008 | Gleeson et al. | 52/489.1 |
| 2010/0037547 | A1* | 2/2010 | Taraba et al. | 52/289 |
| 2011/0061316 | A1* | 3/2011 | Tonyan et al. | 52/169.1 |

* cited by examiner

*Primary Examiner* — Brian Glessner
*Assistant Examiner* — Paola Agudelo
(74) *Attorney, Agent, or Firm* — Richard C. Vershave; Foster Pepper PLLC

(57) ABSTRACT

A fire-resistant assembly may be attached to a wall frame assembly of a building and configured to transfer loads from a load-bearing assembly into the wall frame assembly. The assembly provides for a desired amount of fire resistance by virtue of a fire-resistant filler and provides for a desired amount of structural capacity by virtue structural sheets that form a cavity for the filler. In addition, a load-limited connector may be coupled to the assembly to transfer loads from the load-bearing assembly up to a desired load threshold.

12 Claims, 8 Drawing Sheets

WALL SYSTEM FOR A BUILDING

PRIORITY CLAIM

This application claims the benefit of the filing date of U.S. Provisional Patent Application No. 61/289,034 filed on Dec. 22, 2009, the subject matter of which is herein incorporated by reference in its entirety.

FIELD OF THE INVENTION

The present invention generally relates to a system that is both fire-resistant and structurally robust (e.g., load carrying and/or weight bearing), and more specifically to a structural and fire-resistant system configured to meet a variety of building code requirements.

BACKGROUND OF THE INVENTION

Many regions throughout the world, in particular regions that are subject to seismic activity, have fire, structural, seismic and other codes that must be met during the design, construction and even retrofit of a building. Such buildings may take the form of, but are not limited to, commercial buildings, office buildings, churches, schools, convention halls, theatres, and even many types of residential and multi-family complexes.

The International Building Code (IBC) is one type of code and is also the model building code that has been adopted throughout most of the United States. The IBC differs from the related International Fire Code (IFC) in that the IBC addresses fire prevention in regard to construction and design, whereas the IFC addresses fire prevention in regard to the operation of a completed and occupied building. For example, the building code sets criteria for the number, size and location of exits and types of walls in the design of a building while the fire code requires the exits of a completed and occupied building to be unblocked. The building code also deals with structural stability and seismic requirements. The IBC applies to all structures in areas where it is adopted, except generally for one and two family dwellings, which are typically covered by the International Residential Code.

By way of example, a portion of the IBC dealing with fire walls states they must meet both fire and structural requirements. More specifically, fire walls are required to be continuous from foundation to a termination point at least thirty inches above the adjacent roofs, with a number of exceptions allowing the termination at the underside of roof and fire walls must have sufficient structural stability under fire conditions to allow the collapse of construction on either side of the wall without affecting the rating of the wall. In addition, a seismic portion of the code requires that all parts of the structure between separation joints be interconnected to form a continuous load path and the interconnection forces must be below an acceptable threshold, which may be defined in the code.

The effect of structural provision is that the fire wall may not be vertically supported by either side of the wall, and must be laterally supported by both sides—where the lateral supports are required to adequately brace the wall while not being strong enough to damage the wall during collapse. The effect of the seismic provision is that unless there is a separation joint at the fire wall, then the building must be interconnected across the fire wall, while still allowing collapse on either side. However, if a separation joint is provided at the fire wall, then a significant amount of seismic drift would need to be accommodated. It is unlikely that any sort of wall brace would be consistent with an accommodation of seismic motion.

Even where the IBC has not been adopted, local building codes often require that a fire wall be located between certain rooms or adjacent an exterior space. A fire portion of the local code requires the fire wall to have a two-hour fire resistance rating. As implied in the IBC, this fire rating may be achieved by constructing the fire wall so that it is continuous from foundation to roof. The structural portion of the local code may further require the fire wall to have sufficient structural stability and strength to allow for the collapse of an opposing wall in the room, similar to the IBC. And, a seismic portion of the local code may require that all portions of the building be interconnected or otherwise structurally tied together to form a continuous load path. In short, the three primary code requirements may be summarized as a fire wall that (1) has a two-hour fire rating; (2) is sufficiently stable and strong in the event of a collapse; and (3) is interconnected with other portions of the building to form part of the continuous load path. However, meeting these three requirements generates to a multitude of design challenges, a complex installation process, and increase costs.

In stud-framed buildings, the two-hour fire rating requirement may be achieved with gypsum board (e.g., drywall, wallboard, plasterboard, etc.) assembled into a two-hour fire wall having an unbroken plane where the fire wall is independently and laterally supported on both sides. However, gypsum board is a relatively soft material with limited structural capacity, therefore concurrently achieving the structural and seismic requirements is essentially impossible unless the loads on the drywall are sufficiently low. In short, the known construction options for meeting all portions of the code relating to fire walls are limited.

FIGS. 1-4 show various fire wall systems that either currently exist or could potentially be constructed to better local code requirements. However, each option has drawbacks, whether it is the complexity of the assembly, its ability to carry load, or its ability to achieve the unbroken plane where the fire wall system is independently and laterally supported on both sides.

FIG. 1 shows a prior-art fire wall system 100 anchored by wall studs 102 and a sole plate assembly 104. Two layers of fire-rated wallboard 106, 108 are attached at least to the studs 102 on a non-floor bearing side of the system 100. Two additional layers of fire-rated wallboard 110, 112 are attached at least to the studs 102 on the floor-bearing side of the system 100. A floor girder 114, provided to carry a floor assembly 116, is structurally independent from the sole plate assembly 104 and wallboard layers 110, 112. The floor assembly 116 is secured to the floor girder 114. In the illustrated embodiment the floor assembly 116 includes a floor sheathing panel 118, floor joists 120, joist hangers 122, and fire-rated sub-floor panels 124. The fire wall system 100 does not meet all the code requirements because the system does not include interconnection anchors across the wall, in which the anchors are strong enough to resist interconnection loads, but would not damage the wall under a partial collapse condition. Even if such anchors were provided, the system 100 would be expensive and difficult to install.

FIG. 2 shows an example of alternate fire wall systems 200 mounted back-to-back to achieve seismic separation. For purpose of brevity, only one of the systems 200 will be described. The fire wall system 200 includes wall studs 202 and a sole plate assembly 204 that engages a floor sheathing panel 206 of a floor assembly 208. Two layers of fire-rated wallboard 210, 212 are attached at least to the studs 202. Two additional, non-continuous layers of fire-rated wallboard 214, 216 are attached at least to the studs 202, above and below the floor assembly 208, respectively. In the illustrated embodiment the floor assembly 208 includes the floor sheathing member 206, floor joists 218, and at least one fire-rated sub-floor panel 220. Unlike the system 100 shown in FIG. 1, the present system 200 does not include a floor girder or joist hangers. Nevertheless, the system 200 would be expensive and difficult to install.

FIG. 3 shows yet another type of fire wall system 300, which is similar to an area separation wall system described in the Gypsum Association Fire Resistance Design Manual, 17$^{th}$ Ed. (April 2003). The fire wall system 300 includes two fire-rated panels 302, 304 with vertical edges set into steel H studs 306 and with horizontal edges sent into upper and lower runners 308, 310, respectively. The fire wall system 300 is distinct from the adjacent stud walls while being laterally supported by either or both of the stud walls. While there are firewall-to-stud wall connectors that are designed for partial building collapse, such connectors are incompatible with seismic interconnection forces and do not have an appropriate amount of flexibility to allow both sides of the fire wall system 300 to move independently, while at the same time rigidly anchoring the fire wall system 300 to both stud walls. Thus, one drawback of the fire wall system 300 is that it is not seismically independent. In addition, the system 300 would be expensive and difficult to install.

SUMMARY OF THE INVENTION

An embodiment of the present invention includes a fire-resistant, structural assembly configured to address at least some of the known difficulties encountered with designing and installing a fully code-compliant fire wall, such as in multi-story buildings located within seismic areas. The assembly maintains the fire-resistance of a fire-rated wall assembly and provides the ability to transfer substantial structural loads, for example loads from a floor assembly into the wall assembly. The assembly is fire-resistant by virtue of a fire-resistant filler and load-bearing capable by virtue of structural facings or sheets coupled to the filler. In one embodiment, the sheets are configured to (1) facilitate lapping of wall sheathing; and (2) provide sufficient structural capacity to span between supports.

The assembly may be fastened directly to wall framing and include shoulders or edges configured to mate with overlapping sheets of fire-resistant drywall, which in turn establishes an unbroken plane of fire-resistance material. The assembly provides a surface to which other structural connectors, such as load-limited connectors, joist hangers, shear transfer clips, etc. may be attached. The filler, which may be a gypsum-based material or another type of adequate fire-retardant or fire-resistant material that is also capable of transferring loads from an exterior sheet to an interior sheet of the assembly.

In one aspect of the present invention, an assembly for a fire wall system includes a first structural sheet arranged with a second structural sheet to define a cavity, at least one of the sheets having a perforated stiffener extending out-of-plane from the sheet; and a fire-resistant filler received in the cavity, the filler extending from the cavity through the perforations and filling at least a portion of the stiffener.

In another aspect of the present invention, an assembly includes a first structural sheet arranged with a second structural sheet to define a cavity; a fire-resistant filler received in the cavity; and at least one load-limited device secured to one of the sheets.

In yet another aspect of the present invention, a fire wall system includes a fire-resistant assembly having a first structural sheet arranged with a second structural sheet to define a cavity, at least one of the sheets having a perforated stiffener extending out-of-plane from the sheet, the assembly further having a fire-resistant filler received in the cavity, the filler extending from the cavity through the perforations and filling at least a portion of the stiffener; a fire-resistant wallboard panel supported by a flange extending from at least one of the structural sheets; and a load-bearing assembly coupled to the fire-resistant assembly.

In still yet another aspect of the present invention, a method of installing a fire wall in a building includes the steps of (1) fastening a fire-resistant assembly to a wall frame assembly of the building, the fire-resistant assembly having a first structural sheet arranged with a second structural sheet to define a cavity, at least one of the sheets having a perforated stiffener extending out-of-plane from the sheet, the assembly further having a fire-resistant filler received in the cavity, the filler extending from the cavity through the perforations and filling at least a portion of the stiffener; (2) abutting a fire-resistant wallboard panel against an edge surface of the fire-resistant assembly; and (3) coupling a load-bearing assembly to the fire-resistant assembly.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENTS

The present invention generally relates, but is not limited, to a fire-resistant and structural wall system for a building. For purposes of the description herein, the phrase "fire-resistant" is interpreted broadly to include any material that has at least some ability to slow, retard, stop or otherwise interfere with the progress of a fire. In at least one embodiment, the present invention includes a fire-resistant assembly having structural facings that cooperate to define a cavity in which a fire-resistant filler is received. A load-bearing member, which may be configured to support a floor assembly, is coupled to the fire-resistant assembly. In addition, fire-resistant wallboard panels are supported on shoulders, edges, or other surfaces of the fire-resistant member in such a manner as to meet a fire code in which the wall should be continuous from a desired starting point to a desired termination point (e.g., from a foundation to a point proximate a ceiling).

The fire-resistant and structural wall system may be incorporated into a building to comply with fire continuity, structural stability, and seismic code requirements. One purpose of the wall system as described herein is that it may be an extension or a component of a fire-rated wall system while providing a code approved structural attachment means for a floor assembly.

Figure 1:
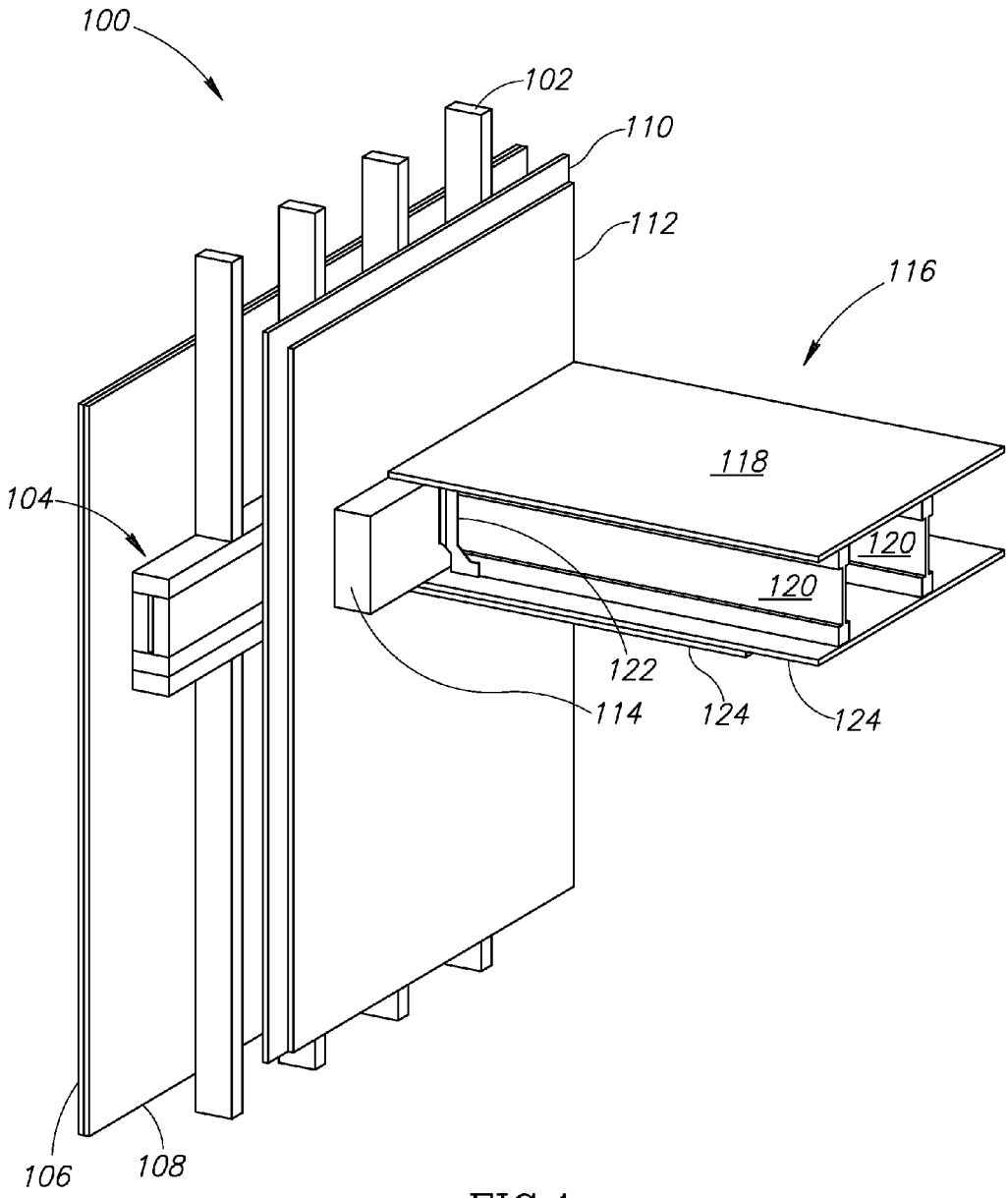
FIG.1 (PRIOR ART)
FIG. 1 is a perspective view of a prior-art fire wall system.
Figure 2:
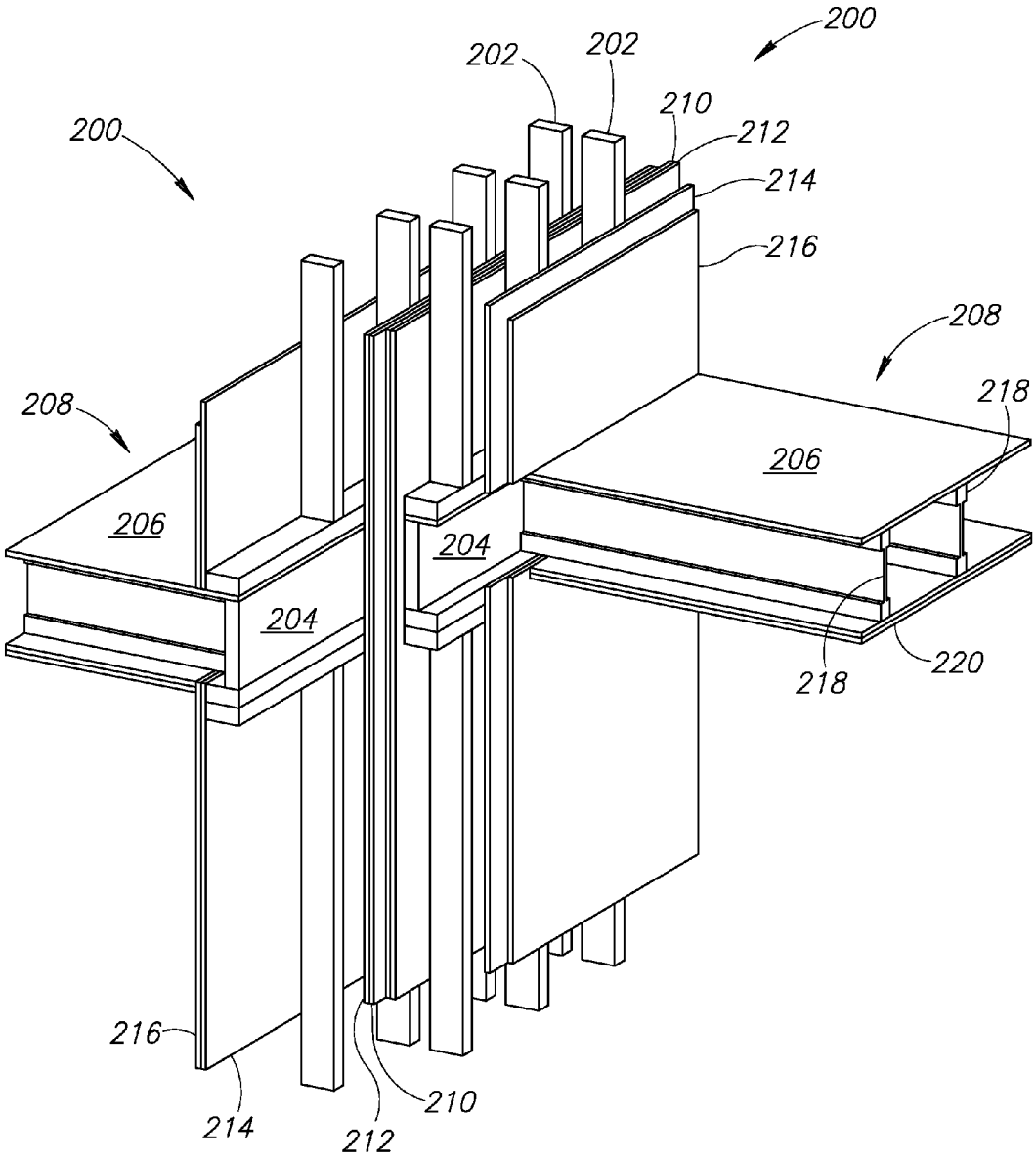
FIG.2 (PRIOR ART)
FIG. 2 is a perspective view of another prior-art fire wall system.
Figure 3:
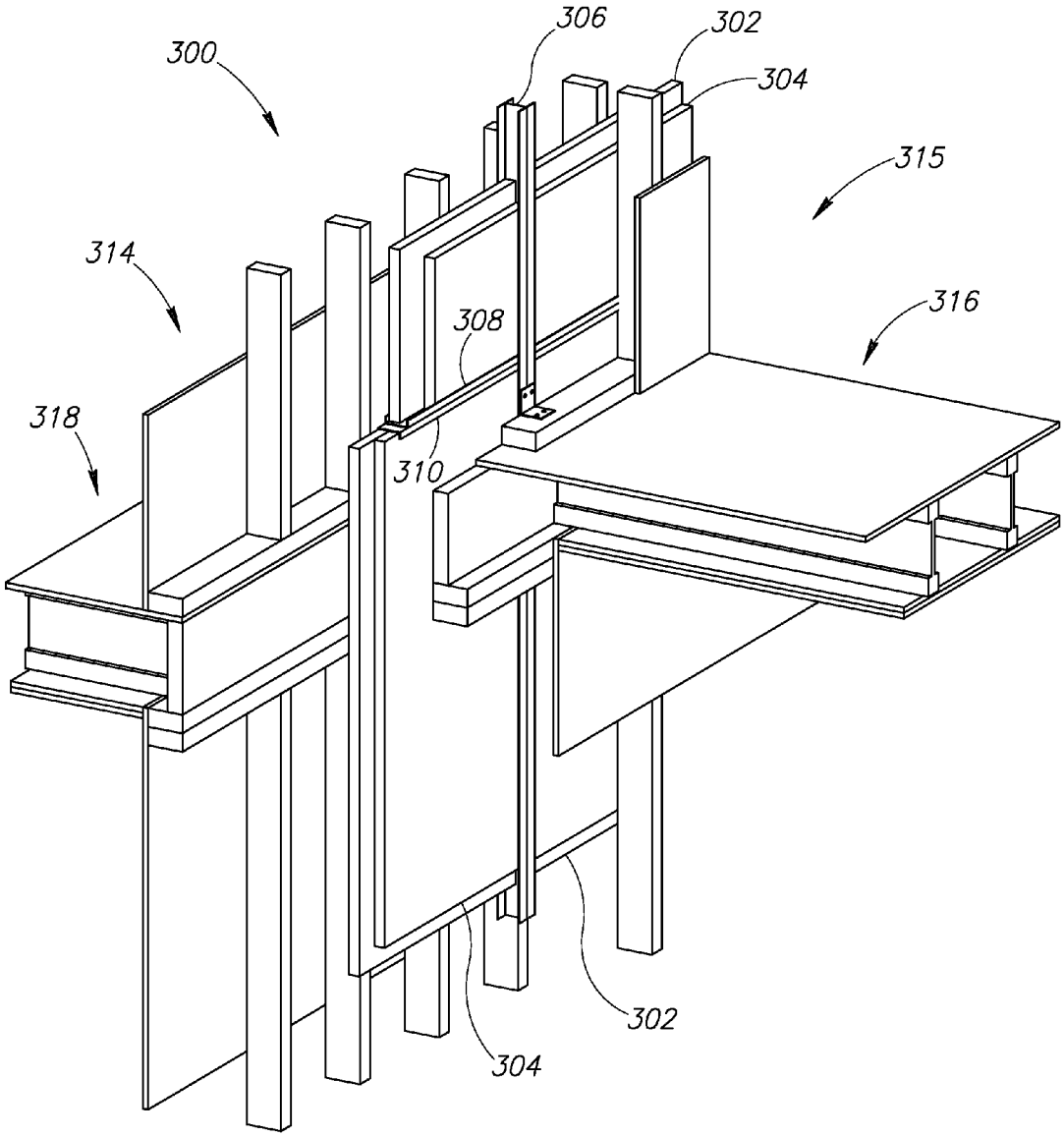
FIG.3 (PRIOR ART)
FIG. 3 is a perspective view of yet another prior-art fire wall system.
Figure 4:
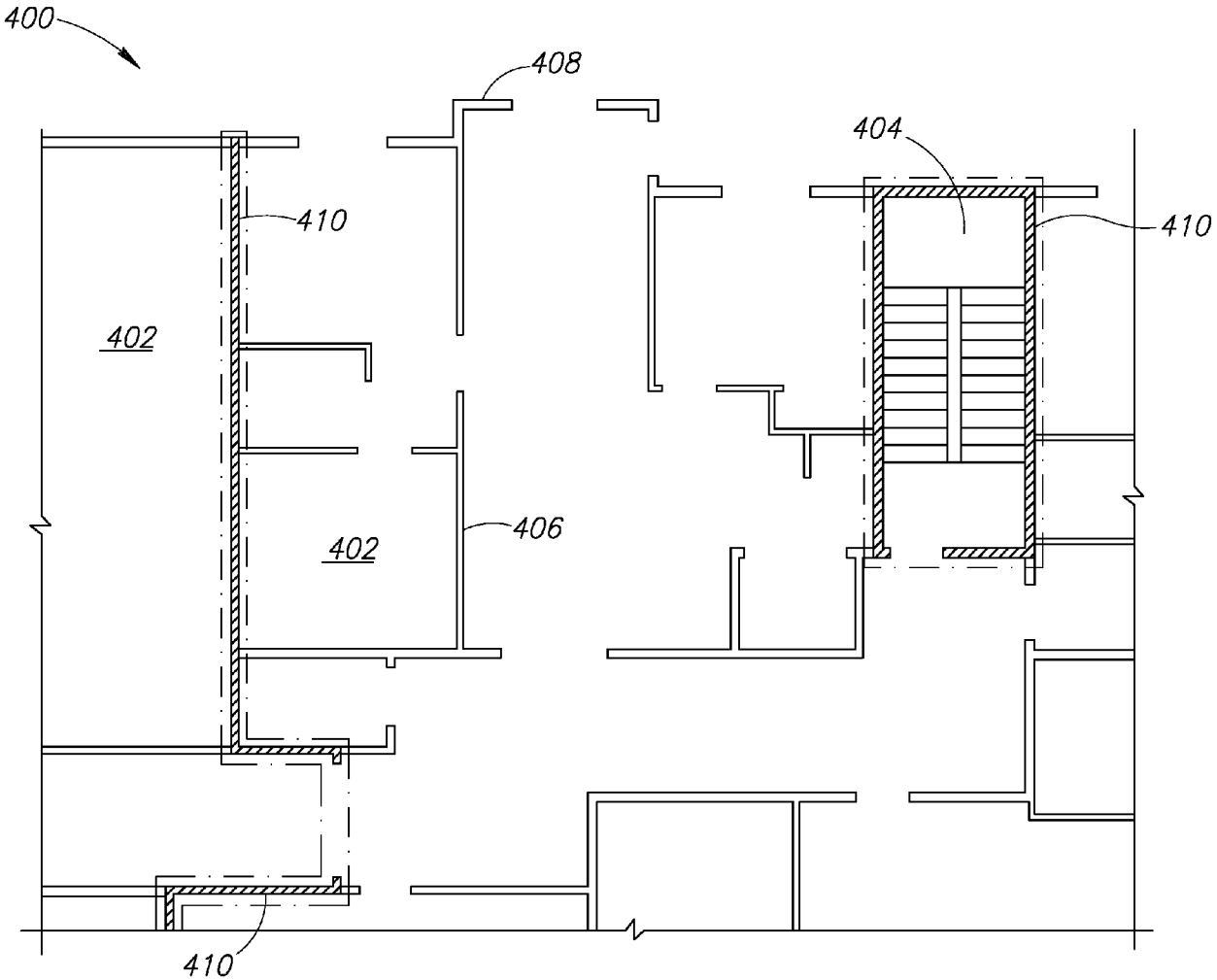
FIG. 4 is a plan view of a floor in a building having at least one fire-resistant and structural wall system according to an embodiment of the present invention.

FIG. 4 shows a floor plan view of building 400 having a plurality of rooms 402 and a stairwell region 404. The building 400 may have interior walls 406 and exterior walls 408. Further, some of the walls 406, 408 may be fire walls 410 according to at least one embodiment of the present invention as described in more detail below.

Figure 5:
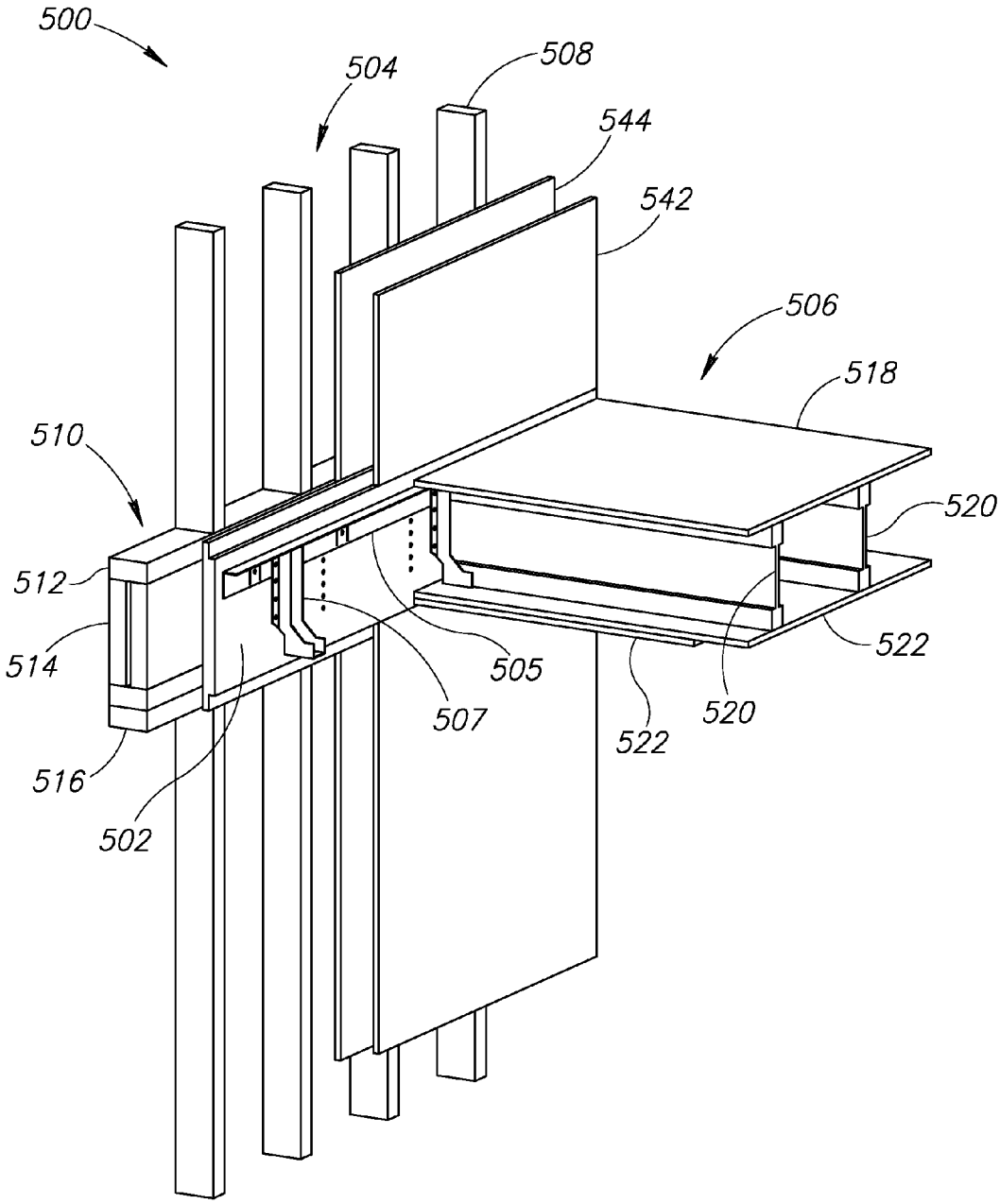
FIG. 5 is a perspective view of a fire-resistant and structural wall system having a fire-resistant assembly according to an embodiment of the present invention.

FIG. 5 shows a fire-resistant and structural wall system 500 having a fire-resistant assembly 502 coupled to a wall frame assembly 504. A load-limiting connector 505 is coupled to the assembly 502. In the illustrated example, the fire-resistant assembly 502 supports a floor assembly 506 through a plurality of joist hangers 507. The wall frame assembly 504 includes a plurality of studs 508 and a sole plate assembly 510 that may include a bearing wall sole plate 512, a floor beam 514, and lower bearing wall caps 516. Further in the illustrated embodiment, the floor assembly 506 includes a floor sheathing panel 518, floor joists 520 and at least one fire-rated lower floor panel 522. It is appreciated that the frame assembly 504 may take the form of a wood or metal frame assembly while the floor assembly 506 may take other forms depending on the design and/or loading requirements for the building.

Figure 6:
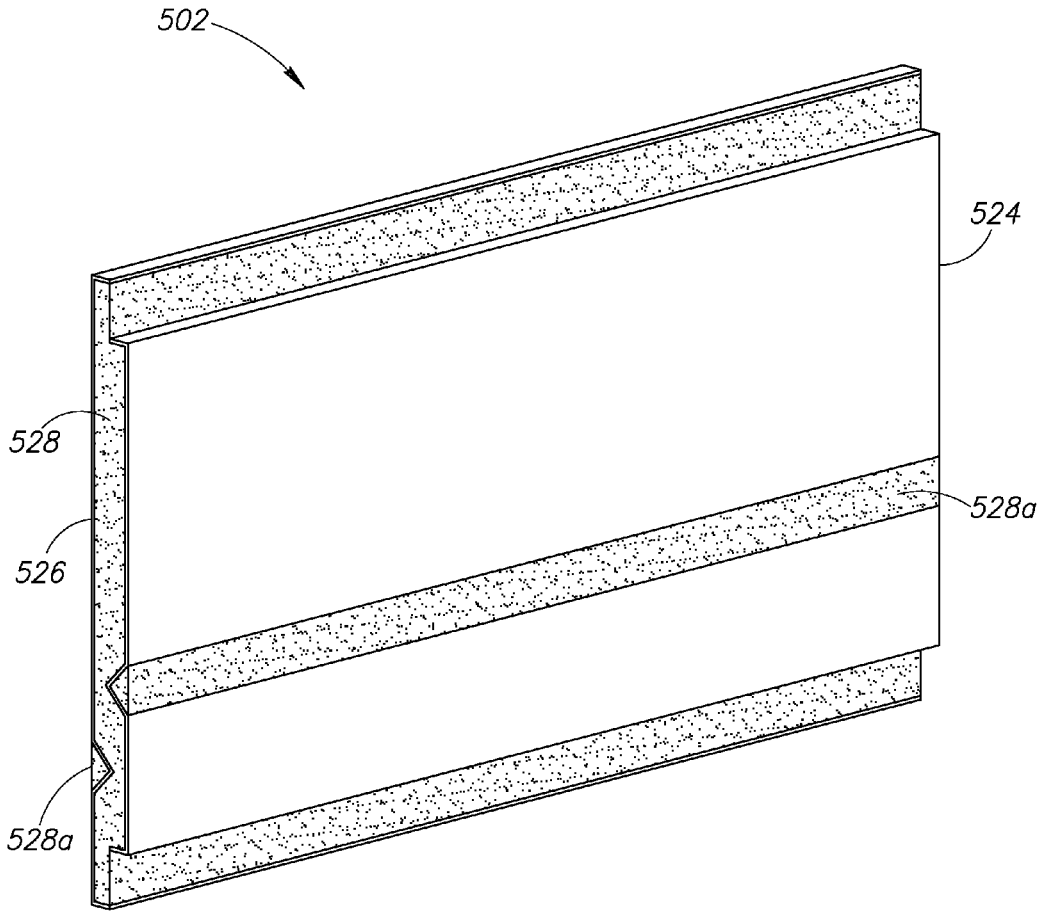
FIG. 6 is a perspective view of the fire-resistant assembly of FIG. 5 according to an embodiment of the present invention.

Referring now to FIG. 6 while still referring to FIG. 5, the assembly 502 may take the form of a composite member having first and second structural facings 524, 526 and a fire-rated filler 528 arranged between the facings 524, 526. The facings 524, 526 provide the ability to make structural connections to the assembly 502 while the filler 528 operates to transfer loads from the floor assembly 506 to the wall frame assembly 504 or vice-versa. The filler 528 may also operate to structurally fix the facings 524, 526 relative to each other and also provide a desired level of fire resistance.

Figure 7:
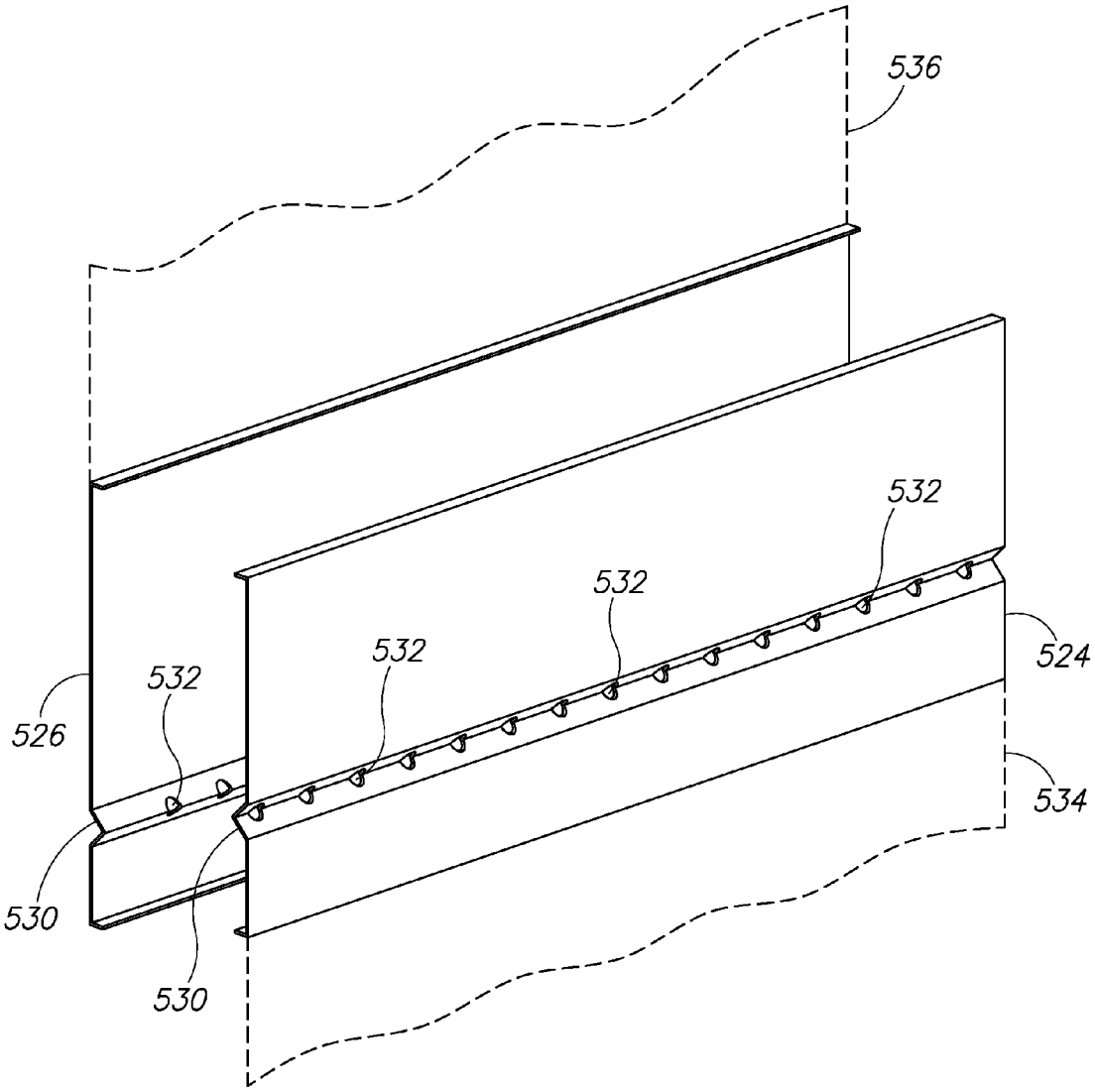
FIG. 7 is an exploded, perspective view of the facings of the fire-resistant assembly of FIG. 5 according to an embodiment of the present invention.

Referring now to FIG. 7 while still referring to FIGS. 5 and 6, the facings 524, 526 may be made from thin gage steel sheets (e.g., 18-gage) with each having a stiffener 530 with a plurality of openings 532. The stiffeners 530 may operate as perforated ribs to increase the shear capacity of the assembly 502. The stiffeners 530 are illustrated as triangular in shape, but may have other shapes such as, but not limited to, semicircular, rectangular, etc. Regardless of the shape, the stiffeners 530 extend out-of-plane relative to primary planes 534, 536 associated with the facings 524, 526, respectively. The openings 532, likewise, may have non-circular shapes. As best shown in FIG. 6, the channels 530 may be substantially filled with the filler 528, indicated as stiffener filler 528*a*, which in turn provides a means for the filler 528 to structurally attach to the facings 524, 526 and also keep them oriented and otherwise aligned relative to each other.

Each facing 524, 526 may further include upper and lower flanges 538, 540, which are preferably bent at right angles relative to the primary planes 534, 536. The flanges 538, 540 may provide a bearing area for transferring loads through the filler, may provide a structural shoulder or surface to support or otherwise abut with a wallboard panel, and may also be offset to indicate to an installer which surface of the assembly 502 is attached to the wall frame assembly 504 versus the floor assembly 506 (FIG. 5). The facings 524, 526 allow for structural attachments to the assembly 502, for example the attachment of the connector 505 or joist hangers 507 (FIG. 5).

In a preferred embodiment, the filler 528 may take the form of a gypsum-based filler that provides the desired level of fire resistance and establishes a continual fire rating that is at least equivalent to fire-rated wallboard panels 542, 544 (FIG. 5). In one embodiment, the filler 528 is comprised of gypsum cement (alpha-gypsum) with an aggregate mixture of expanded perlite, unexpanded perlite and glass fibers. The use of alpha gypsum typically results in a higher strength plaster and a less viscous mixture as compared to commonly known plaster of Paris (beta gypsum) even though the chemical composition of the two products is identical ($2CaSo_4+2H_2O$). Expanded perlite is used to lighten the product and increase its insulating ability, whereas the unexpanded perlite further increases fire resistance. Glass fibers are added to increase overall strength and ductility of the filler 528.

In another embodiment, the filler 528 make take other forms which may or may not include gypsum as an ingredient or component. By way of example, the filler 528 may take the form of a graphite-based filler, an intumescent material, such as a DELPHI® intumescent material made by Delphi Technologies, Inc., a fire-resistant composition as described in WO/2001/044404, or any other material that provides a sufficient level of fire resistance to meet local code requirements.

Figure 8:
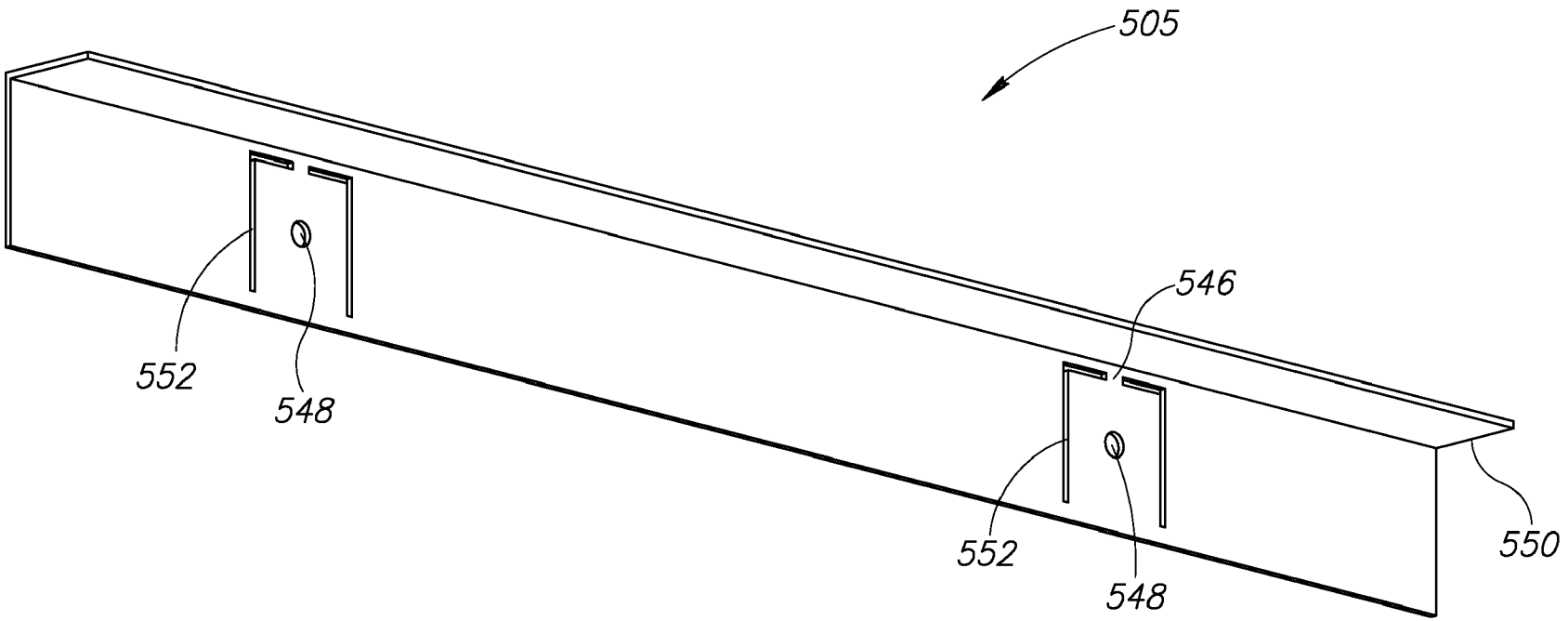
FIG. 8 is a perspective view of a load-limited connector attachable to the fire-resistant assembly according to an embodiment of the present invention.

FIG. 8 shows the load-limiting connector 505, which may take the form of a tension-limited diaphragm connector. In one embodiment, the connector 505 includes tabs 546 designed to limit an amount of load transferred through a fastener connection point 548 during a floor collapse or partial collapse. Note in FIG. 5 the floor sheathing panel 518 is supported on an outstanding flange 550 of the connector. During a condition when the floor collapses, an increased amount of force will be distributed over the flange 550, but because of a cutout region 552 formed around the connection point 548, all of the force must be directed through the tab 546. Therefore, by controlling a length, thickness and material of the tab 546, the amount of stress induced into the fire-resistant assembly 502 may be limited in that the tab 546 may be designed to fail at a desired force threshold.

Alternatively stated, the connector 505 may take the form of a structurally fused connector that permits local separation or failure when a threshold load or stress is reached. Thus, the structurally fused connectors may advantageously prevent the assembly 502 from being pried apart or damaged when another portion of the building fails. By way of example, when the failure of an opposite wall increases the floor loading the structurally fused connector permits separation of the floor with minimal damage to the wall so as to maintain the fire and structural integrity of the wall.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A fire-resistant and structural wall system comprising:

a wall frame assembly:

a fire-resistant assembly coupled to the wall frame assembly, the fire-resistant assembly having a first structural member spaced apart from a second structural member, the first structural member having an upper planar sheet and a lower planar sheet, the first structural member further having an integral stiffener extending from the upper and lower planar sheets, the integral stiffener extending out-of-plane from the upper and lower planar sheets, the integral stiffener forming a channel having channel walls that include a plurality of perforations;

a fire-resistant filler received between the first and second structural members, the filler also extending through the plurality of perforations to fill the channel of the integral stiffener while providing, structural continuity between the channel and the space between first and second structural members;

a floor assembly; and a plurality of joist hangers coupled to floor assembly and respectively coupled to the fire-resistant assembly, wherein the fire-resistant assembly structurally supports the floor assembly while maintaining a desired fire rating for the wall frame assembly.

2. The assembly of claim 1 wherein the structural members are metal.

3. The assembly of claim 1, further comprising at least one load transfer device securable to one of the structural members.

4. The assembly of claim 3, wherein the load transfer device is a load-limited connector.

5. The assembly of claim 1 wherein each structural member includes an outstanding flange for supporting a wallboard panel.

6. The assembly of claim 5 wherein the outstanding flange of the first structural member is vertically offset from the outstanding flange of the second structural member.

7. The assembly of claim 1 wherein the fire-resistant filler is a gypsum-based filler.

8. A method of installing a fire wall in a building, the method comprising:

fastening a fire-resistant assembly to a wall frame assembly of the building, the fire-resistant assembly having a first structural member spaced apart from a second structural member, the first structural member having an upper planar sheet and a lower planar sheet, the first structural member further having an integral stiffener extending from the upper and lower planar sheets, the integral stiffener extending out-of-plane from the upper and lower planar sheets, the integral stiffener forming a channel having channel walls that include a plurality of perforations, the fire-resistant assembly having a fire-resistant filler received between the first and second structural members, the filler also extending through the plurality of perforations to fill the channel of the integral stiffener while providing structural continuity between the channel and the space between first and second structural members;

supporting a fire-resistant wallboard panel on an edge surface of the fire-resistant assembly; and coupling a load-bearing structure to the fire-resistant assembly with a plurality of joist hangers coupled to floor assembly and respectively coupled to the fire-resistant assembly, wherein the fire-resistant assembly structurally supports the load-bearing assembly while maintaining a desired fire rating for the wall frame assembly.

9. The method of claim 8 wherein supporting the fire-resistant wallboard panel against the edge surface of the fire-resistant assembly includes abutting the fire-resistant wallboard panel against an outstanding flange of one of the structural members.

10. The method of claim 8 wherein supporting the fire-resistant wallboard panel includes bringing the wallboard panel into contact with the fire-resistant assembly.

11. The method of claim 8 wherein fastening the fire-resistant assembly to the wall frame assembly includes pre-drilling the fire-resistant assembly.

12. The method of claim 8 wherein coupling the load-bearing assembly to the fire-resistant assembly includes connecting the load-bearing assembly to the fire-resistant assembly with a load-limited connector.

* * * * *